US006195055B1

(12) United States Patent
Jones

(10) Patent No.: US 6,195,055 B1
(45) Date of Patent: Feb. 27, 2001

(54) DISH ANTENNA HEATING ASSEMBLY

(75) Inventor: Thaddeus M. Jones, Bremen, IN (US)

(73) Assignee: MSX, Inc., South Bend, IN (US)

( * ) Notice: Subject to any disclaimer, the term of this patent is extended or adjusted under 35 U.S.C. 154(b) by 0 days.

(21) Appl. No.: 09/333,714

(22) Filed: Jun. 15, 1999

(51) Int. Cl.[7] ..... H01Q 1/02
(52) U.S. Cl. ..... 343/704; 343/912
(58) Field of Search ..... 343/704, 713, 343/711, 912, 840; H01Q 1/02, 15/16

(56) References Cited

U.S. PATENT DOCUMENTS 2,679,003 * 5/1954 Dyke et al. ..... 343/704
4,866,452 * 9/1989 Barma et al. ..... 343/704
5,010,350 * 4/1991 Lipkin et al. ..... 343/704
5,796,368 * 8/1998 Arthur ..... 343/704
5,844,526 * 12/1998 Jones ..... 343/704
5,963,171 * 10/1999 Jones ..... 343/704

* cited by examiner

*Primary Examiner*—Tho Phan
(74) *Attorney, Agent, or Firm*—Taylor & Aust, P.C.

(57) ABSTRACT

A dish antenna heating assembly includes a dish antenna having a convex rear surface. a heating element associated with at least a portion of the convex rear surface a fabric cover overlying at least that portion of the convex rear surface with which the heating element is associated, and spacer elements disposed between the convex rear surface of the dish antenna and the fabric cover.

19 Claims, 2 Drawing Sheets

DISH ANTENNA HEATING ASSEMBLY

1. FIELD OF THE INVENTION

The present invention relates to antenna reflectors and, more particularly, heated antenna reflectors.

2. DESCRIPTION OF THE RELATED ART

A reflector, commonly called a dish, is generally a parabolic section having a round, elliptical or other configuration. Dish antennas are typically used to receive and transmit electromagnetic signals, such as radio frequency (RF) or microwave signals transmitted to or received from a satellite or other source. When used for receiving signals, the parabolically-shaped reflector of the dish antenna serves to reflect and focus received signals onto a detecting or amplifying unit, known as a feed horn, positioned at the focal point of the dish antenna.

The performance of a typical dish antenna is dependent upon and greatly affected by the geometrical accuracy, or integrity, of the shape of the parabolic reflective surface and the position of the amplifying unit relative to the focal point of the reflected electromagnetic signals. If the parabolic reflective surface of the dish antenna is deformed, the electromagnetic signals may not be reflected to a single focal point, or the position of that focal point may be significantly shifted from its design position. The strength of the reflected electromagnetic signals received by the amplifying unit may therefore be of dramatically reduced strength. Thus, physical distortion of the parabolic reflecting surface ultimately results in significantly degraded antenna performance and, therefore, degraded reception quality.

Dish antennas vary widely in size, having diameters ranging approximately from less than one meter to in excess of seven meters, and are typically constructed of light weight materials, such as aluminum mesh, providing little or no structural support or rigidity. Typically, dish antennas are installed in locations where they are exposed to the harsh outside environment, including the precipitation of snow and/or ice which may accumulate on the parabolic reflecting surface of the antenna. The weight of accumulated snow and/or ice may distort the shape of the parabolic reflecting surface, particularly where the antenna is constructed of materials offering little or no structural support or rigidity as discussed above. Such physical distortion, by affecting the integrity of the parabolic shape of the reflecting surface, may significantly degrade the performance of the antenna.

The mounting of various insulating covers and/or heating elements onto a dish antenna may prevent the accumulation of snow or ice on the antenna. However, when these devices are mounted to a dish antenna the load they place on the structure thereof may be of a sufficient magnitude to result in the distortion of the parabolic reflector. Typical insulating covers and/or heating element devices for dish antennas are installed adjacent to the rear side of the parabolic reflector and are physically attached to the outer rim of the dish antenna, thus placing a load on the structure of the dish antenna. This load is magnified by the moment arm that results from the attachment of such devices to the outer rim of the dish antenna. Thus, the physical distortion of the parabolic reflecting surface and the degradation in antenna performance are also magnified.

The assembly of the various insulating covers and/or heating elements, and the attachment thereof to a dish antenna, typically involves a number of component parts and an associated assortment of assembly and mounting hardware, such as bolts, nuts, screws and other fasteners.

Thus, installation of the various insulating covers and/or heating elements may be a difficult and labor-intensive task requiring a certain degree of mechanical skill, and perhaps requiring the labor of more than one person.

Typical insulating covers passively retain heat generated by the heating element by insulating the heated portion or surface of the dish antenna from the ambient environment. Such a passive insulating cover may be constructed of a dense and, therefore, relatively heavy, material, in order to achieve a certain insulation factor and/or efficiency. Insulating covers constructed of such materials typically have a fixed size and shape. Thus, installation of the various insulating covers is further complicated due to their weight, bulk, fixed size and shape, and rigidity.

Therefore, what is needed in the art is a dish antenna heating assembly that is lightweight, flexible and/or pliable, and is therefore easy to install. Furthermore, what is needed in the art is an antenna dish heating assembly that actively reflects heat back toward the dish antenna surface being heated.

SUMMARY OF THE INVENTION

The present invention provides a dish antenna heating assembly for use with a dish-type antenna that is very lightweight, pliable, and simple to install. Furthermore, the present invention provides a dish antenna heating assembly having an insulating cover that reflects heat back toward the portion or surface of the dish antenna over which it lies.

The invention comprises, in one form thereof, a dish antenna heating assembly including a dish antenna having a convex rear surface, a heating element associated with at least a portion of the convex rear surface, a fabric cover overlying at least the portion of the convex rear surface with which the heating element is associated, and spacer elements disposed between the convex rear surface of the dish antenna and the fabric cover.

An advantage of the present invention is that the dish antenna heating assembly is very light in weight and imposes a negligible load on the structure of the dish antenna, thus preventing distortion of the parabolic reflecting surface and preserving antenna performance.

Another advantage is that the accumulation of snow and/or ice on the parabolic reflecting surface of the dish antenna is prevented, thus preventing distortion of the parabolic reflecting surface and preserving antenna performance.

Yet another advantage is that the heater assembly can be easily installed by one person, and may be installed on antennas that are already installed in their operating positions.

A further advantage is that the insulating cover reflects heat back toward the portion or surface of the dish antenna to which it is attached.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
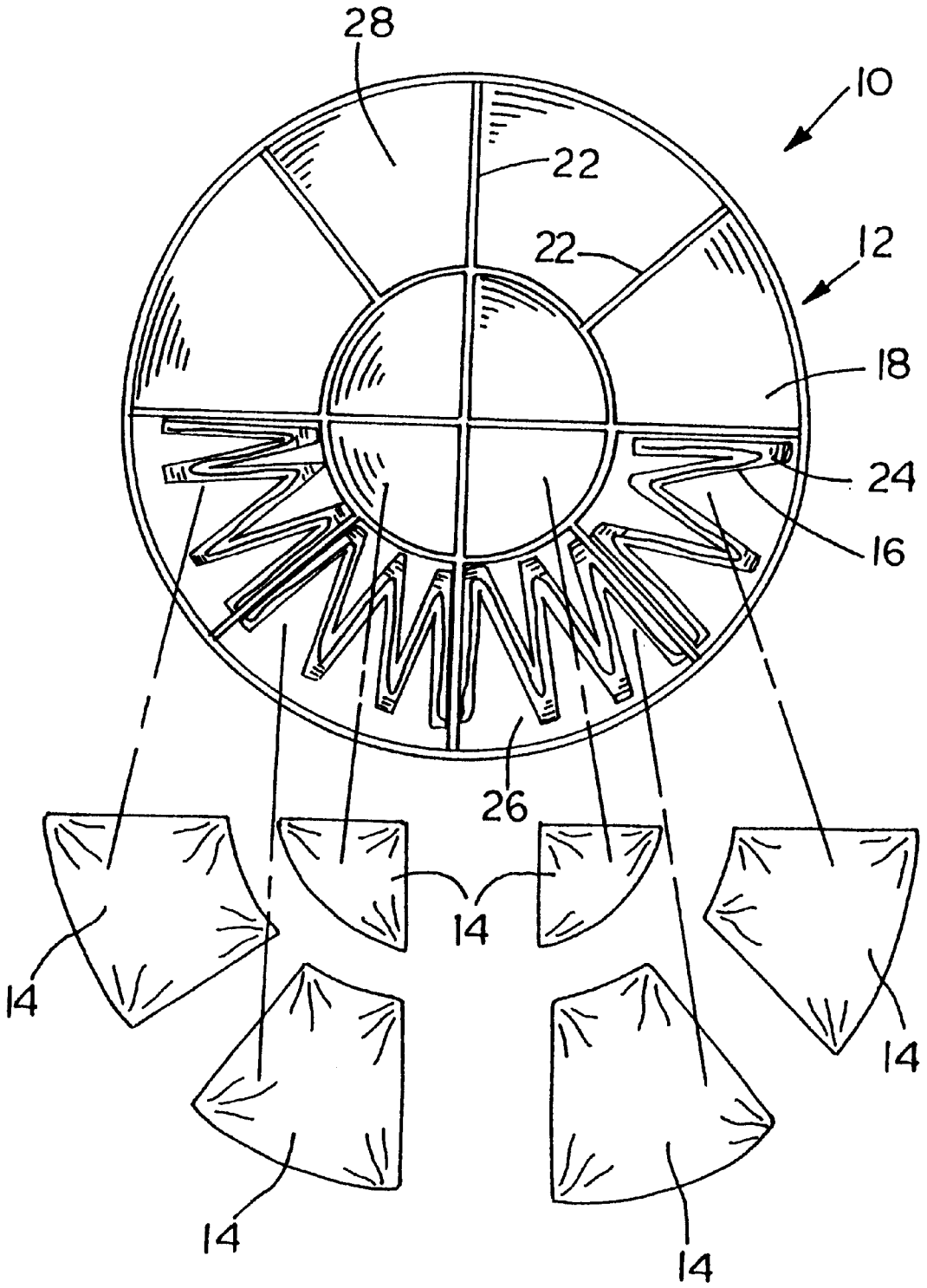
FIG. 1 is a rear view of an embodiment of a dish antenna heating assembly of the present invention.

Referring now to the drawings, and particularly to FIG. 1, there is shown a dish antenna heating assembly 10 of the present invention. Dish antenna heating assembly 10 includes dish antenna 12, a plurality of cover sections 14, and heating element 16.

Dish antenna 12 has a convex rear surface 18 having a plurality of ribs 22 extending transversely therefrom. Ribs 22 provide structural support to dish antenna 12. Ribs 22 are shown as extending radially outward from center 23 of dish antenna 12 on convex rear surface 18. However, it is to be understood that ribs 22 can be arranged in many different configurations.

Cover sections 14 each include a respective inner surface 13. Each of cover sections 14 further include a respective inner layer 14*a* (FIG. 2) and a respective outer layer 14*b*, and are shaped to fit between a corresponding adjacent pair of ribs 22. In the embodiment shown, each respective outer layer 14*b* of cover sections 14 is constructed of a waterproof nylon fabric material that is pliable, durable, thermally insulative, lightweight, flame retardant and resistant to the degrading effects of exposure to ultra-violet (UV) light. One example of such a material is a polytetrafluoroethelene membrane bonded to a nylon fabric. Such a material is commonly known as GORE-TEX (a trademark of W.L. Gore Associates). Examples of other fabrics and/or materials suitable for use in construction of cover sections 14 include, for example, polyvinyl chloride (PVC) fabric or sheeting. Each respective inner layer 14*a* of cover sections 14 is constructed of a heat-reflecting material, such as, for example, aluminum or metallic foil. Each of cover sections 14 is attached at their respective inner surfaces 13 to the convex rear surface 18 of dish antenna 12 by double-sided tape 24. In the embodiment shown, cover sections 14 are installed on the lower half 26 of convex rear surface 18 of dish antenna 12. However, it is to be understood that cover sections 14 can be installed on any portion, or the entirety, of convex rear surface 18.

Heating element 16 is a resistive heating element that is attached to convex rear surface 18 of dish antenna 12 by double-sided adhesive tape 24. In the embodiment shown, heating element 16 is arranged in a serpentine pattern on the lower half 26 of convex rear surface 18 of dish antenna 12. However, it is to be understood that heating element 16 can be disposed in any of a number of patterns on either or both of top half 28 and bottom half 26 of convex rear surface 18. Heating element 16 is connected to a power source (not shown).

Double-sided adhesive tape 24 is a tape having adhesive on each of its sides and is constructed of a flame retardant material such as, for example, a metallic foil. In the embodiment shown, double-sided tape 24 and heating element 16 are separate and distinct elements. However, it is to be understood that heating element 16 and double-sided tape 24 could be combined into an integral heating tape by, for example, embedding, or sandwiching, a heating element between two layers of metallic foil tape having adhesive on appropriate surfaces thereof.

In use, dish antenna heating assembly 10 is installed on dish antenna 12 by adhering heating element 16 to convex rear surface 18 with double-sided tape 24. Heating element 16 can be arranged in any manner or pattern on, and over any desired portion of, convex rear surface 18. It is preferred that heating element 16 be arranged in a serpentine pattern, thereby covering a significant portion of convex rear surface 18 with heating element 16 and ensuring adequate heating of dish antenna 12. The backing of double-sided tape 24 is then removed, and cover sections 14 are individually pressed into place over double-sided tape 24, between an adjacent pair of ribs 22. This process is repeated for each of cover sections 14 until the desired portion of dish antenna 12 is covered. Activating heating element 16 heats convex rear surface 18 of dish antenna 12, thereby preventing any accumulation of or melting any already accumulated snow or ice thereon. Fabric cover sections 14, and their respective inner layers 14*a* , retain heat proximate to and reflect heat back toward convex rear surface 18 of dish antenna 12, thereby increasing the efficiency of heating element 16.

Figures 2, 3:
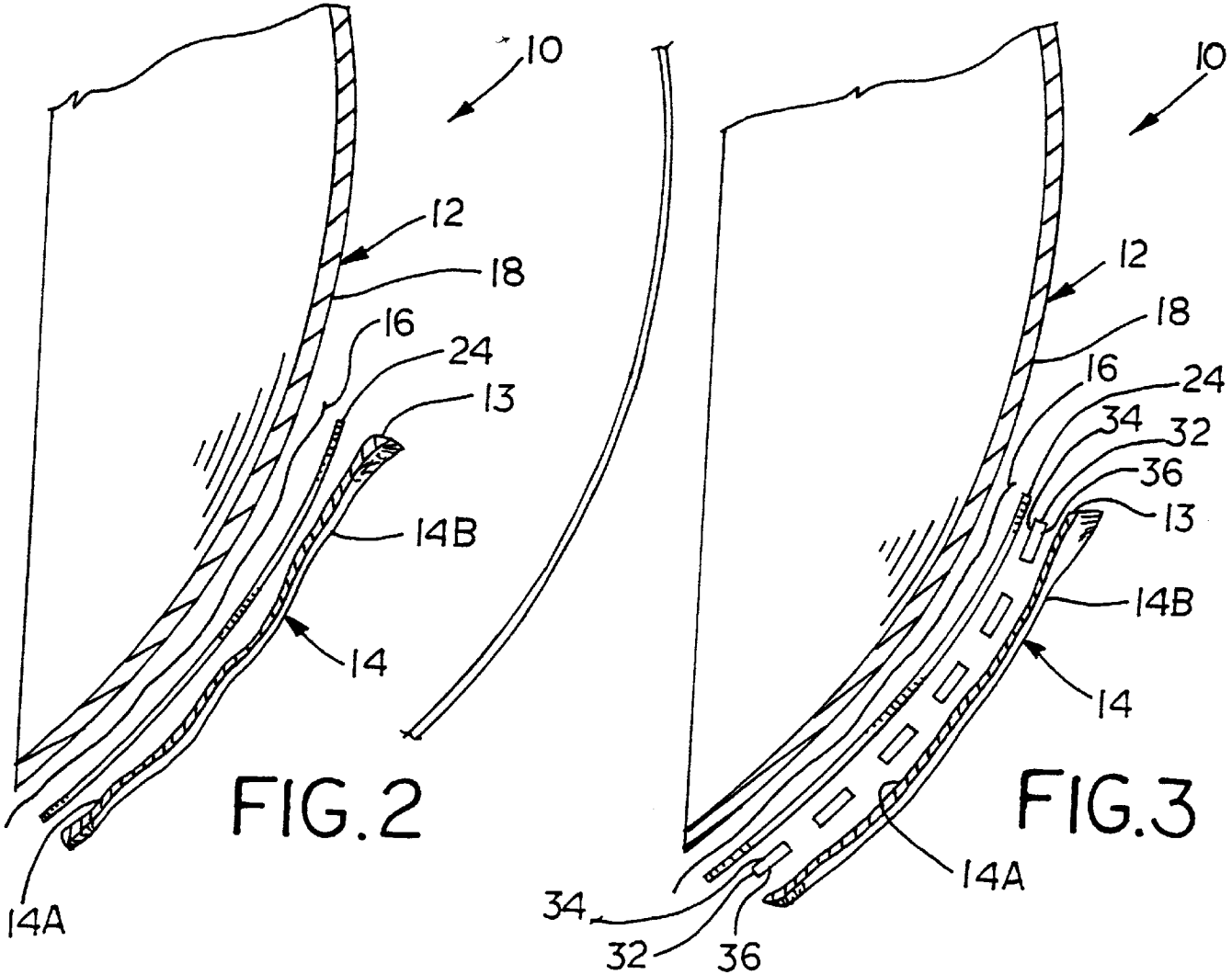
FIG. 2 is a fragmentary, side view of the dish antenna heating assembly of FIG. 1.
FIG. 3 is a fragmentary, side view of a second embodiment of a dish antenna heating assembly of the present invention.

FIG. 3 illustrates a second embodiment of a dish antenna heating assembly 10 of the present invention. In this embodiment, spacer elements, or blocks, 32 are disposed between convex rear surface 18 of dish antenna 12 and the inner surface 13 of each cover sections 14. Spacer blocks 32 are constructed of a flame-retardant, thermally and electrically insulative material such as, for example, foam plastic. Each of spacer blocks 32 has a respective inner adhesive surface 34 and a respective outer adhesive surface 36. Each respective inner adhesive surface 34 of spacer blocks 32 is attached to the convex rear surface 18 of dish antenna 12. Each respective outer adhesive surface 36 of spacer blocks 32 is attached to a corresponding one of cover sections 14, at the inside surface 13 thereof. Spacer blocks 32 are positioned on and spaced about convex rear surface 18 so as to separate the inner layers 14*a* of cover sections 14 from heating element 16. In the embodiment shown, each respective inner adhesive surface 34 and outer adhesive surface 36 of each spacer block 32 carries an adhesive such as, for example, glue. However, it is to be understood that the inner adhesive surface 34 and outer adhesive surface 36 of each spacer block 32 can be formed of double-sided tape or a strip of hook-and-loop fastener material such as, for example, Velcro.

In use, spacer blocks 32 are adhered at their inner adhesive surfaces 34 to the convex rear surface of dish antenna 12. The inner surfaces 13 of cover sections 14 attach or adhere to the outer adhesive surface 36 of a respective spacer block 32. Any necessary number of spacer blocks 32 can be used to attach a cover section 14 to, and space a cover section 14 from, dish antenna 12.

In the embodiment shown, each inner layer 14*a* of cover sections 14 is constructed of a heat-reflecting layer of material, such as, for example, aluminum foil. It is to be understood, however, that the cover sections 14, formed of GORTEX or other suitable material as described herein, can be formed without inner surface 14*a* being constructed of a heat-reflecting layer of material.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A dish antenna assembly, comprising:

a dish antenna having a convex rear surface;

at least one heating element associated with at least a portion of said convex rear surface;

at least one fabric cover section substantially overlying at least said portion of said convex rear surface, said fabric cover section adapted for retaining heat proximate to said convex rear surface; and an adhesive layer disposed between said convex rear surface of said dish antenna and said at least one fabric cover section.

2. The dish antenna assembly of claim 1, wherein said adhesive layer has an inner surface attached to said convex rear surface of said dish antenna.

3. The dish antenna assembly of claim 2, wherein said adhesive layer has an outer surface, said at least one fabric cover section including an inner cover surface, said outer surface of said adhesive layer attached to said inner cover surface.

4. The dish antenna assembly of claim 3, wherein said layer of adhesive material comprises at least one of glue, double-sided adhesive tape, and hook-and-loop fastener material.

5. The dish antenna assembly of claim 1, wherein a plurality of spacer elements is disposed between said adhesive layer and said at least one fabric cover section, said at least one fabric cover section being spaced apart from said at least one heating element by said plurality of spacer elements.

6. The dish antenna assembly of claim 5, wherein said plurality of spacer elements is formed of an electrically and thermally insulating, flame-retardant material.

7. The dish antenna assembly of claim 6, wherein said plurality of spacer elements is formed of foam plastic.

8. The dish antenna assembly of claim 5, wherein said plurality of spacer elements is at least one of block shaped, cube shaped, wedge shaped, and cylindrical shaped.

9. The dish antenna assembly of claim 1, wherein said at least one cover section and said convex rear surface of said dish antenna define an air gap therebetween, at least one spacer element being disposed within said air gap.

10. The dish antenna assembly of claim 1, wherein said at least one fabric cover section is formed of at least one of a polytetrafluorethelene membrane bonded to a layer of nylon fabric and a polyvinyl chloride material.

11. The dish antenna assembly of claim 1, wherein said at least one fabric cover section includes a heat-reflecting inner cover surface.

12. The dish antenna assembly of claim 11, wherein said heat-reflecting inner cover surface comprises a layer of heat-reflective metallic foil.

13. The dish antenna assembly of claim 1, wherein said at least one heating element comprises at least one resistive heating element attached by double-sided tape to said convex rear surface of said dish antenna.

14. A heater assembly for a dish antenna, the dish antenna having a convex rear surface, said heater assembly comprising:

at least one heating element associated with at least a portion of the convex rear surface of the dish antenna; and at least one fabric cover section substantially overlying at least said portion, said at least one fabric cover section and said convex rear surface defining an air gap therebetween.

15. The heater assembly of claim 14, wherein said at least one fabric cover section is comprised of at least one of a polytetrafluorethelene membrane bonded to a layer of nylon fabric material and a polyvinyl chloride material.

16. The heater assembly of claim 14, wherein at least one of said at least one heating element and said at least one fabric cover section is attached to the convex rear surface of the dish antenna by double-sided adhesive tape.

17. The heater assembly of claim 14, wherein said at least one fabric cover section includes a heat-reflecting inner surface.

18. The heater assembly of claim 17, wherein said heat-reflecting inner surface of said at least one fabric cover section comprises a layer of heat-reflecting metallic foil.

19. The heater assembly of claim 14, wherein the convex rear surface of the dish antenna further includes a plurality of ribs extending transversely therefrom, said at least one fabric cover section comprising a plurality of individual cover sections, each of said individual cover sections being shaped to substantially correspond with and be attached to a respective portion of the convex rear surface of the dish antenna, each said respective portion being defined by an adjacent pair of the plurality of ribs.

* * * * *